US008182668B1

(12) United States Patent
Yaseen et al.

(10) Patent No.: US 8,182,668 B1
(45) Date of Patent: May 22, 2012

(54) METHOD FOR PRODUCING A BARIUM TITANATE LAYER BY CATHODIC ELECTROPHORETIC DEPOSITION FROM AQUEOUS SOLUTION

(75) Inventors: Hanady Yaseen, Haifa (IL); Yoed Tsur, Mishmar Haemeq (IL)

(73) Assignee: Technion Research and Development Foundation Ltd., Haifa (IL)

( * ) Notice: Subject to any disclaimer, the term of this patent is extended or adjusted under 35 U.S.C. 154(b) by 708 days.

(21) Appl. No.: 12/181,821

(22) Filed: Jul. 29, 2008

(51) Int. Cl.
*C25D 13/02* (2006.01)

(52) U.S. Cl. ..... 204/491

(58) Field of Classification Search ..... 204/490, 204/491

See application file for complete search history.

(56) References Cited

U.S. PATENT DOCUMENTS

| | | | | |
|---|---|---|---|---|
| 5,039,598 | A | 8/1991 | Abramsohn et al. | |
| 5,451,304 | A | 9/1995 | Markfort et al. | |
| 5,753,316 | A | 5/1998 | Brent et al. | |
| 6,705,152 | B2 | 3/2004 | Routkevitch et al. | |
| 6,724,520 | B2 | 4/2004 | Kawai | |
| 6,846,588 | B2 | 1/2005 | Sarkar | |
| 6,866,896 | B2 | 3/2005 | Heimann et al. | |
| 6,887,361 | B1 * | 5/2005 | Visco et al. | 204/491 |
| 2007/0045116 | A1 | 3/2007 | Hung et al. | |

FOREIGN PATENT DOCUMENTS

| | | | |
|---|---|---|---|
| WO | 01/86030 | A1 | 11/2001 |
| WO | 2004/046425 | A2 | 6/2004 |

OTHER PUBLICATIONS

Zarbov et al., "Methodology for selection of charging agents for electrophoretic deposition of ceramic particles", Journal of Material Science (2004), 39:813-817.*

Halder et al., Microstructure and electrical properties of BaTiO3 and (Ba,Sr)TiO3 ferroelectric thin films on nickel electrodes, J. Sol-Gel Sci Techn (2007) 42:203-207.*

Hanady Yassen, Sioma Baltianski & Yoed Tsur, 'Cathodic, electrophoretic deposition of barium titanate films from aqueous solution', Journal of Materials Science, vol. 42, No. 23 (Dec. 2007), pp. 9679-9683, Publisher—Springer Netherlands.

Juan Li, Yong Jun Wu, Hidetaro Tanaka, Takahisa Yamamoto & Makoto Kuwabara, 'Preparation of a Monodispersed Suspension of Barium Titanate Nanoparticles and Electrophoretic Deposition of Thin Films', Journal of the American Ceramic Society, vol. 87, No. 8 (2004), pp. 1578-1581.

K Yamashita, M Nagai & T Umegaki, 'Fabrication of green films of single- and multi- component ceramic composites by electrophoretic deposition technique', Journal of Material Science, vol. 32 (1997), pp. 6661-6664.

Kui Yao & Weiguang Zhu, 'Barium titanate glass—ceramic thin films for integrated high-dielectric media', Thin solid films, vol. 408 (2002), pp. 11-14.

(Continued)

*Primary Examiner* — Kishor Mayekar
(74) *Attorney, Agent, or Firm* — Reches Patents

(57) ABSTRACT

A method for producing a Barium Titanate layer, the method includes: receiving or preparing an aqueous solution that comprises water and Barium Titanate; wherein the aqueous solution is characterized by a high positive zeta potential, low conductivity and a high pH value; electrophoretically depositing Barium Titanate from the aqueous solution on a base metal cathode while substantially preventing oxidation of the base metal cathode; drying the deposited Barium Titanate; and sintering the deposited Barium Titanate while substantially preventing the oxidation of the base metal cathode.

17 Claims, 8 Drawing Sheets

OTHER PUBLICATIONS

Y.J. Wu, J. Li. H. Tanaka, M. Kuwabara, 'Preparation of nano-structured BaTiO3 thin film by electrophoretic deposition and its characterization', Journal of the European Ceramic Society, vol. 25, issue 12 (2005), pp. 2041-2044.

Sridhar Venigalla, James H Adair, 'Theoretical Modeling and Experimental Verification of Electrochemical Equilibria in the Ba-Ti-C-H2O System', Chemistry of Materials, vol. 11, pp. 589-599.

Jialing Zhao, Xiaohui Wang & Longtu Li, Electrophoretic deposition of BaTiO3 films from aqueous suspensions; Materials Chemistry and Physics (2006), pp. 350-353.

Jianping Zhang & Burtrand I. Lee, 'Electrophoretic Deposition and Characterization of Micrometer-Scale BaTiO3 Based X7R Dielectric Thick Films', Journal of the American Ceramic Society, vol. 83, No. 10 (2000), pp. 2417-2422.

Steven Limmer, Seana Seraji, Yun Wu, Tammy Chou, Carolyn Nguyen & Guozhong Cao, 'Template-Based Growth of Various Oxide Nanorods by Sol-Gel Electrophoresis', Advanced Functional Materials, vol. 12, No. 1 (Jan. 2002), pp. 59-64.

Steven Limmer & Guozhong Cao, 'Sol-Gel Electrophoretic Deposition for the Growth of Oxide Nanorods', Advanced Materials, vol. 15, No. 5 (Mar. 2003) pp. 427-431.

Aydin Dogan, Goktug Gunkaya, Ender Suvaci & Markus Neiderberger, 'Electrophoretic deposition of nano-sized BaTiO3', Journal of Material Science, vol. 41 (2006), pp. 8196 to 8201.

Hanady Yaseen, Sioma Baltianski, Yoed Tsur, 'Effect of Incorporating Method of Niobium on the Properties of Doped Barium Titanate Ceramics', Journal of the American Ceramic Society, vol. 89, No. 5 (2006), pp. 1584-1589.

* cited by examiner

110

800

METHOD FOR PRODUCING A BARIUM TITANATE LAYER BY CATHODIC ELECTROPHORETIC DEPOSITION FROM AQUEOUS SOLUTION

FIELD OF THE INVENTION

The present invention relates to method for producing a Barium Titanate layer by Cathodic Electrophoretic deposition from an aqueous solution.

BACKGROUND OF THE INVENTION

Barium Titanate (BaTiO3) is one of the most important ceramic materials in electronics. As an intrinsic ferroelectric material it can be used in various applications, for example: as a multilayer capacitor, a grain boundary capacitor and in thermistors (heat sensitive resistor).

Deposition of Barium Titanate thin films onto metal electrodes is of great interest because of the possibility of integration of a dielectric layer with semiconductor and metal structures.

Electrophoretic deposition (EPD) is an effective technique to prepare a green film of ceramics on a substrate.

Considerable work with organic solutions as the suspension medium for Barium Titanate powders has been done, however the use of organic liquids poses environmental and health hazards due to their toxic nature. In addition, such organic solutions are hard to handle and are costly.

Anodic electrophoretic deposition of Barium Titanate on Platinum anodes was suggested by Zhao J., Wang X, Li L (2006) Mat. Chem. Phys 666: 530. Platinum is not subjected to oxidation but is very expensive.

There is a growing need to provide efficient methods for producing Barium Titanate layers, and in particular thin and crack-free layers.

SUMMARY OF THE PRESENT INVENTION

A method for producing a Barium Titanate layer is provided. The Barium Titanate layer is produced by cathodic electrophoretic deposition from aqueous suspension. The method includes: (i) Receiving or preparing an aqueous solution that comprises water and Barium Titanate; wherein the aqueous solution is characterized by a high positive zeta potential, low conductivity and a high pH value. (II) Electrophoretically depositing Barium Titanate from the aqueous solution on a base metal cathode while substantially preventing oxidation of the base metal cathode. (iii) Drying the deposited Barium Titanate. (iv) Sintering the deposited Barium Titanate while substantially preventing the oxidation of the base metal cathode.

The depositing can include maintaining a voltage potential between an anode and the base metal cathode that substantially prevents Oxidation of the base metal cathode. The voltage potential can range between 0.5 volts and 6 volts and especially can range between 3 and 4 volts.

The method can include maintaining a constant voltage potential between the anode and the base metal cathode during the electrophoretic deposit (also referred to as deposition) of the Barium Titanate.

The method can include maintaining a constant current between the anode and the base metal cathode during the electrophoretic deposit of the Barium Titanate.

The method can include receiving or preparing an aqueous solution that is characterized by a high pH value that is selected to prevent Barium leaching. The high pH values can be about 9.2.

The method can include receiving or preparing an aqueous solution that is characterized by a high zeta potential of about 45 mili-Volts.

The method can include sonicating a mixture of water and a Barium Titanate powder and de-ionized water.

The method can include: (i) allowing the mixture to precipitate to provide a precipitate and supernatant water; and (ii) reducing the conductivity of the mixture by replacing the supernatant water by pure water.

The method can include adding oxalic acid and Polyethyleneimine to the mixture to provide the stability of the aqueous mixture.

The method can include electrophoretically depositing the Barium Titanate on a base metal cathode that is made of Nickel.

The method can include sintering while maintaining a low Oxygen partial pressure. The low Oxygen partial pressure can be about $10^{-10}$ Atmospheres. The low Oxygen partial pressure can be maintained by directing a mixture of $H_2$ gas, dry $N_2$ and wet $N_2$ towards the base metal cathode.

A device is provided. The device includes a Barium Titanate layer. The Barium Titanate layer is manufactured by a manufacturing process that includes: (i) preparing or receiving an aqueous solution that comprises water and Barium Titanate; wherein the aqueous solution is characterized by a high positive zeta potential, low conductivity and a high pH value; (ii) electrophoretically depositing Barium Titanate on a base metal cathode while substantially preventing oxidation of the base metal cathode and a creation of an oxide layer on a surface of the base metal cathode; (iii) drying the deposited Barium Titanate; and (iv) sintering the deposited Barium Titanate while substantially preventing the oxidation of the base metal cathode.

BRIEF DESCRIPTION OF THE DRAWINGS

The present invention will be understood and appreciated more fully from the following detailed description taken in conjunction with the drawings in which.

DETAILED DESCRIPTION OF THE DRAWINGS

In the following specification, the invention will be described with reference to specific examples of embodiments of the invention. It will, however, be evident that various modifications and changes may be made therein without departing from the broader spirit and scope of the invention as set forth in the appended claims.

A method for cathodic electrophoretic deposition of Barium Titanate from aqueous solutions (also referred to as suspensions) is provided. Barium Titanate can be deposited on a cathode made of a base metal such Nickel (Ni) or Copper (Cu) without oxidizing the base metal cathode. The aqueous solution can include water and Barium Titanate and conveniently does not include (or at least does not include a substantially amount of) organic solutions.

The method can facilitate a preparation of layers of Barium Titanate of various shapes, including complex shapes. Accordingly, complex Barium Titanate layers (that act as dielectric layers) can be deposited onto base metals layers for various purposes such as but not limited to cellular phones antennas.

Figure 5:
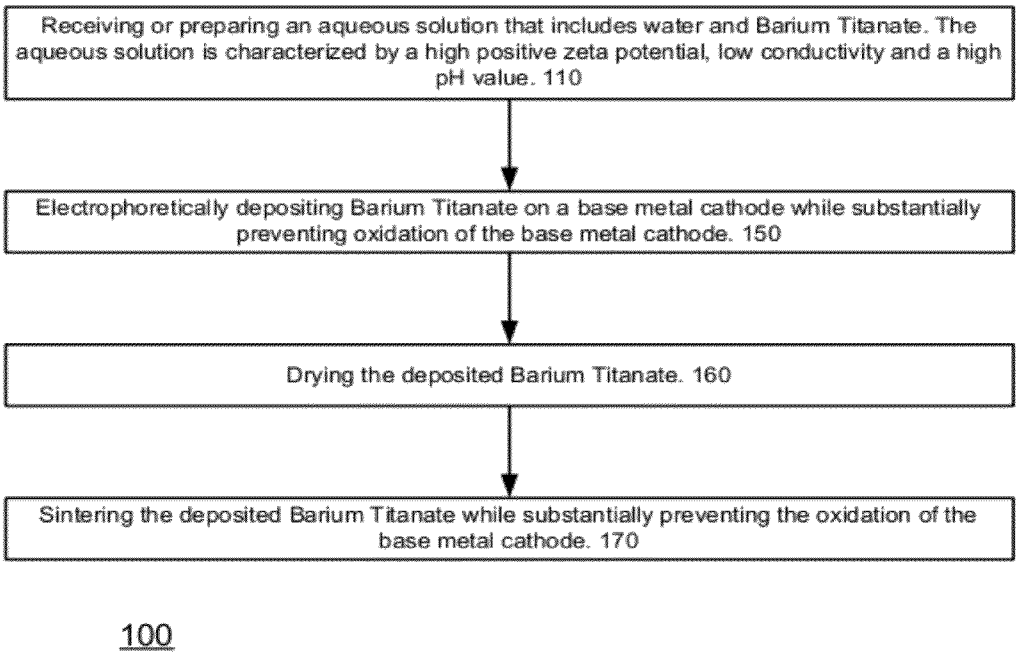
FIG. 5 illustrates a method according to an embodiment of the invention.

FIG. 5 illustrates method 100 for producing a Barium Titanate layer, according to an embodiment of the invention.

Method 100 starts by stage 110 of preparing an aqueous solution that includes water and Barium Titanate. The aqueous solution is characterized by a high positive zeta potential, low conductivity and a high pH value.

The high pH value of the aqueous solution can be selected to prevent Barium leaching during the manufacturing process. Conveniently, the high pH value of the aqueous solution in the present example is about 9.2.

The high zeta potential can be about 45 Mili-Volts. High zeta potential increases the stability of the aqueous solution and is also associated with high electrophoretic mobility.

The high electrophoretic mobility and the low conductivity facilitate a relatively fast deposition process.

Stage 110 can include at least one stage out of stages 112, 114, 116, 118, 120, 122, 124 and 126. Conveniently, stage 110 includes executing a sequence of all of these stages.

Figure 6:
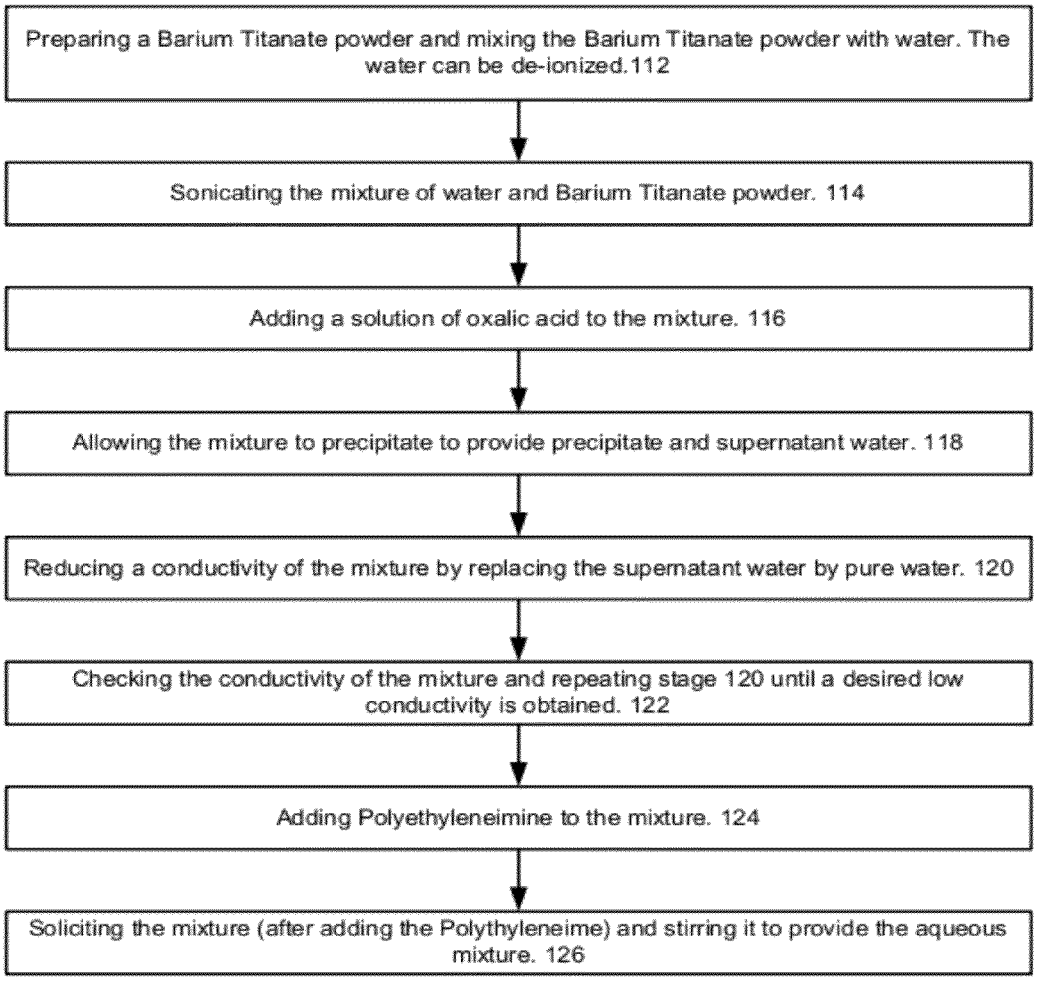
FIG. 6 illustrates a stage of the method of FIG. 5, according to an embodiment of the invention.
Figure 7:
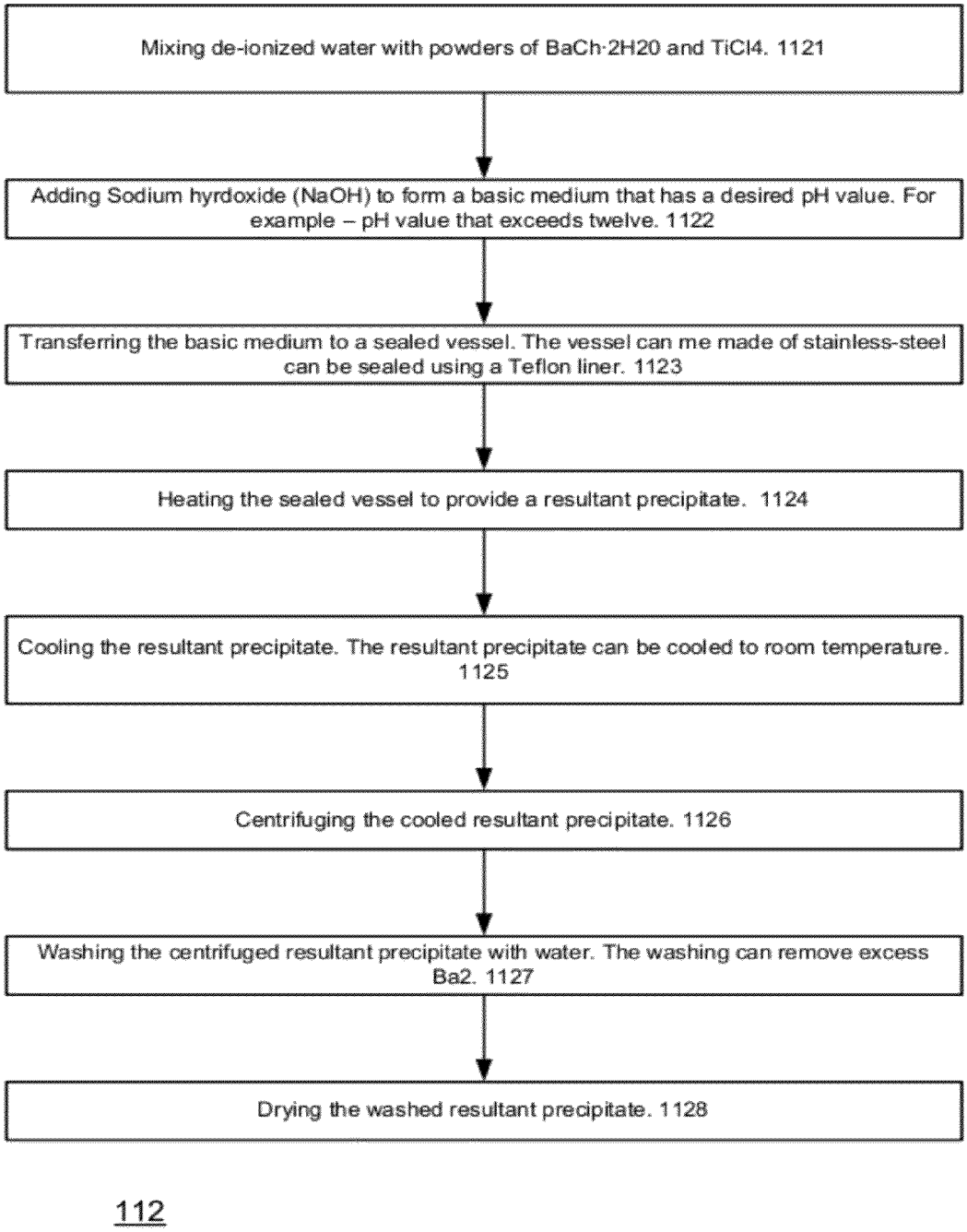
FIG. 7 illustrates a stage of the method of FIG. 5, according to an embodiment of the invention.

FIG. 6 illustrates stage 110 and FIG. 7 illustrates stage 112 according to an embodiment of the invention.

Stage 112 includes preparing a Barium Titanate powder and mixing the Barium Titanate powder with water. The water can be de-ionized.

Stage 112 can include at least one of the following stages or a combination thereof: stage 1121, 1122, 1123, 1124, 1125, 1126, 1127, and 1128. These stages are illustrated in FIG. 6.

Stage 1121 includes mixing de-ionized water with powders of $BaCl_2.2H_20$ and $TiCl_4$. Such powders are commercially available. The $BaCl_2.2H_20$ powder can be obtained from CARLO ERBA, Rodano, Mich. and is 99.6% pure. The $TiCl_4$ powder can be obtained from Aldrich, Milwaukee, Wis. 99.9% pure. It is noted that other powders with other purity levels can be used, and other preparation routes for the nano-powders of Barium Titanate may be utilized.

Stage 1122 includes adding Sodium hyrdoxide (NaOH) to form a basic medium that has a desired pH value. For example, pH value that exceeds twelve.

Stage 1123 includes transferring the basic medium to a sealed vessel. The vessel can be made of stainless-steel with a Teflon liner.

Stage 1124 includes heating the sealed vessel to provide a resultant precipitate. Stage 1124 can include heating the sealed vessel to 100° C. for five hours to provide the resultant precipitate.

Stage 1125 includes cooling the resultant precipitate. The resultant precipitate can be cooled to room temperature.

Stage 1126 includes centrifuging the cooled resultant precipitate.

Stage 1127 includes washing the centrifuged resultant precipitate with water. The washing can remove excess ions.

Stage 1128 includes drying the washed resultant precipitate. The drying can involve drying the washed resultant precipitate at 80° C. for twelve hours in an evacuated oven.

The outcome of stage 112 can be a Barium Titanate powder with an average particle size of 20 nm and specific surface area of 60 $m^2/g$.

Stage 114 includes sonicating the mixture of water and Barium Titanate powder. Stage 114 can include placing an ultrasonic element (such as an ultrasonic finger or horn) in the mixture, and additionally or alternatively, placing the entire mixture within a sonicating bath.

The mixture can be prepared by mixing, for example, 2 grams of Barium Titanate powder with 120 mL of de-ionized water to provide the mixture.

Stage 116 includes adding a solution of oxalic acid to the mixture. The oxalic acid can be obtained from CARLO ERBA, Rodano, Mich., and can be 99.5% pure. One mL of the solution can be added per each 24 mL of de-ionized water of the sonicated mixture.

Stage 118 includes allowing the mixture to precipitate to provide a precipitate and supernatant water.

Stage 120 includes reducing the conductivity of the mixture by replacing the supernatant water by pure water.

Stage 122 includes checking the conductivity of the mixture and repeating stage 120 until a desired low conductivity is obtained.

Stage 124 includes adding Polyethyleneimine to the mixture.

Stage 126 includes sonicating the mixture (after adding the Polythyleneimine) and stirring it to provide the aqueous mixture.

Referring back to FIG. 5, stage 110 is followed by stage 150 of electrophoretically depositing Barium Titanate on a base metal cathode while substantially preventing oxidation of the base metal cathode.

Stage 150 can include stage 152 of maintaining a voltage potential (or current) between an anode and the base metal cathode that substantially prevents oxidation of the base metal cathode. The voltage potential or current can remain constant during the depositing but this is not necessarily so. Even if the voltage potential varies during the depositing it should remain within a range that guarantees that oxidation does not substantially occur. The current should be kept in a range that results in low local zeta potential near the cathode.

Stage 150 can include placing the aqueous solution in a chamber that includes an anode and a cathode. The cathode can be made of a base metal or at least is coated with a base metal. The anode can be made of a stainless steel foil that covers the inner wall of the chamber (such as a beaker).

The base metal cathode can include a nickel foil that is 0.1 mm thick, and has a rectangular shape that is 3 cm long and 2 cm wide. The base metal cathode can be placed at the middle of the chamber or at any other place within the chamber.

A voltage potential was maintained between the anode and cathode by connecting these anode and cathode to a voltage supply unit. The voltage supply unit or a dedicated measurement device can measure the voltage potential, and additionally or alternatively, measure the current that passes through the anode and the cathode. A Keithley 2400 source meter can be used for applying a constant voltage potential and measuring the current, or to supply the constant current and measure the voltage.

Stage 150 is followed by stage 160 of drying the deposited Barium Titanate. Stage 160 can include drying the deposited Barium Titanate in ambient conditions.

Stage 160 is followed by stage 170 of sintering the deposited Barium Titanate while substantially preventing the oxidation of the base metal cathode.

Stage 170 can include sintering the deposited Barium Titanate at 1,200° C. for 2 hours in a reduced atmosphere. Oxygen partial pressure of nominally $10^{-10}$ atmospheres was obtained by mixture of flowing gases. The mixture can include 10 mL/min $H_2$, 10 mL/min dry $N_2$ and 340 mL/min $N_2$ wetted by a bubbler with water at room temperature.

Stage 170 can include maintaining a low Oxygen partial pressure. Especially, maintaining an Oxygen partial pressure of about $10^{-10}$ Atmospheres. This can be achieved by various manners. For example, by directing a mixture of $H_2$ gas, dry $N_2$ and liquid $H_2$ towards the base metal cathode.

Figure 8:
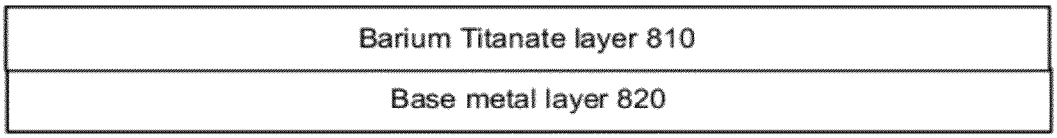
FIG. 8 illustrates a device according to an embodiment of the invention.

FIG. 8 illustrates device 800 according to an embodiment of the invention. Device 800 can include one or more layers of Barium Titanate such as Barium Titanate layers. Device 800 is illustrated in FIG. 6 as including a base metal layer 810 and a Barium Titanate layer 820 that was deposited on the base metal layer 810 that acted as a cathode during a EPD process. Device 800 can be a single or multiple layer capacitor.

Conveniently, Barium Titanate layer 810 includes a Barium Titanate layer, wherein the Barium Titanate layer is manufactured by a manufacturing process that includes: (i) preparing an aqueous solution that comprises water and Barium Titanate; wherein the aqueous solution is characterized by a high positive zeta potential, low conductivity and a high pH value; (ii) electrophoretically depositing Barium Titanate on a base metal cathode while substantially preventing oxidation of the base metal cathode and a creation of an oxide layer on a surface of the base metal cathode; (iii) drying the deposited Barium Titanate; and (iv) sintering the deposited Barium Titanate while substantially preventing the oxidation of the base metal cathode.

EXPERIMENTAL RESULTS

Cathodic electrophoretic deposition (EPD) of Barium Titanate from aqueous suspensions was performed on a nickel cathode. Stable Barium Titanate colloidal suspension with a concentration of 2 g/120 mL at pH of 9.2 has been prepared for the deposition. The characteristics of electrophoretic deposition of those positively charged particles onto cathode were investigated. A uniform and dense layer was obtained for films deposited at 5 V for 10 min. The film thickness for the sintered layer at these conditions was about 150 nm.

The experiments included multiple stages: (i) Barium Titanate powder preparation, (ii) Suspension stabilization and conductivity reduction, and (iii) Cathodic electrophoretic deposition that was conducted under different conditions.

Powder preparation—Barium Titanate powders were prepared by hydrothermal synthesis. Powders of $BaCl_2.2H20$ (CARLO ERBA, Rodano, Mich., 99.6% purity) and $TiCl_4$ (Aldrich, Milwaukee, Wis., 99.9% purity) were mixed with de-ionized water. NaOH was added to form a basic medium according to the stability conditions of BT in a solution (pH>12). Then the solution was transferred to a Teflon liner in a 300 mL stainless-steel vessel. The sealed vessel was heated to 100° C. for 5 h. The resultant precipitate was cooled to room temperature, centrifuged, washed with water to remove excess ions and dried at 80° C. for 12 h in an evacuated oven. The resulting BT was nano-powder with an average particle size of 20 nm and specific surface area of 62 $m^2/g$.

Suspension stabilization and conductivity reduction—for the application of EPD, both stabilization of the colloidal system and low electrical conductivity of the suspension are required. Stabilization of Barium Titanate aqueous suspension was done as follows: 2 g of Barium Titanate powder was added to 120 mL of de-ionized water. The received mixture was dispersed using an ultrasonic horn. Solution of 0.1 M oxalic acid ($(COOH)_2.2H20$) (CARLO ERBA, Rodano, Mich., 99.5% purity) was prepared and 5 mL of the solution was added to the sonicated mixture. After a short time, the powder was precipitated. This system was washed by replacing the supernatant water by pure water repeatedly until the conductivity of the suspension reached 10 μS/cm. 80 mL of PEI (Polyethyleneimine) (ALDRICH, Milwaukee, Wis., 50 wt. % solution in water) was then added for steric stabilization, followed by sonication for 30-60 min and stirring. This resulted in a stable white suspension with the desired properties.

EPD setup—A Two-electrode cell arrangement was used for the EPD process. The anode was a stainless steel cylindrical or flat foil (stainless steel type 304, 0.025 mm thick). The cathode was a nickel panel (nickel metal foil, 0.1 mm thick). A Keithley 2400 source-meter was used for applying the constant voltage and measuring the current or vice versa. The experiments were performed at different values of constant voltage or current, ranging between 1 V and 6 V, which were conducted for 2-20 min at room temperature.

The average thickness of the electrodeposited Barium Titanate films was determined either by cross section micrographs or by weighing the cathode before and after deposition, using: Lambda=(Vtotal−VNi)/S, where S is the surface area of the cathode, Vtotal is the volume of the deposited layer plus the cathode (after sintering) and VNi is the volume of the cathode as determined by Archimedes' method.

The density of the green body without large pores, if such pores exit, can be determined by: p (density)=(Wtotal−WNi)/(Vtotal.green—Vni), where Wtotal and WNi are the weight of the cathode after and before the deposition respectively. The relative density is ρ/ρtheo; (ρtheo=6.02 g $cm^{-3}$).

The deposited surface coatings were dried in ambient conditions, and then sintered at 1,200° C. for 2 hours in a reduced atmosphere. Oxygen partial pressure of nominally $10^{-10}$ Atm. was obtained by mixture of flowing gases: 10 mL/min $H_2$, 10 mL/min dry $N_2$ and 340 mL/min $N_2$ wetted by a bubbler with water at room temperature.

Particle size distribution was measured by a dynamic light scattering (DLS) and the zeta potential was measured by laser Doppler and phase analysis (PALS). Both were measured using a zeta PALS (Brookhaven Instruments Corporation) particle sizer, equipped with a 35 mW and 660 nm wavelength solid state laser and an avalanche diode detector. An image of the deposited Barium Titanate layer was obtained by using a Jeol JSM-5400 scanning electron microscope with energy dispersive X-ray spectroscopy (EDS), working at 15 kV. The densities were measured using the Archimedes method.

An aqueous solution (also referred to as suspension) of 2 g/120 mL of Barium Titanate in water was electrophoretically deposited under constant voltage and constant current experiments.

Figure 1:
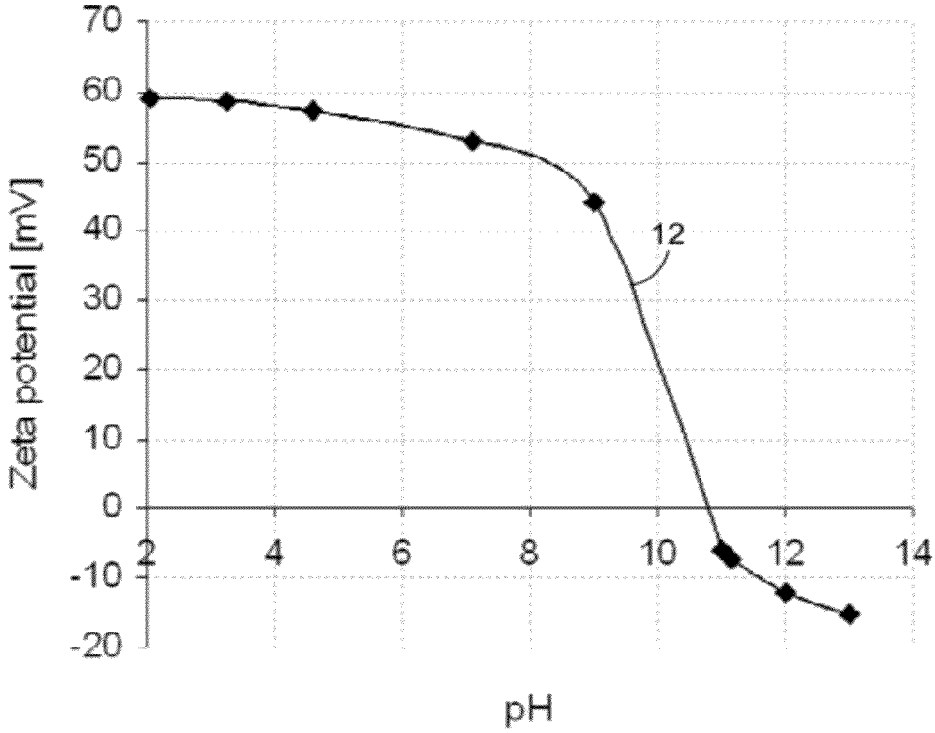
FIG. 1 illustrates a zeta potential of the aqueous solution as a function of its pH value according to an embodiment of the invention.

FIG. 1 and table 1 illustrate the zeta potential of the aqueous solution as a function of its pH value. Table 1 illustrates some points on graph 12 that represents the relationship between Zeta potential and pH values.

TABLE 1

| Zeta Potential (mV) | pH value |
|---|---|
| 60 | 2 |
| 58 | 3.7 |
| 56 | 4.4 |
| 53 | 7 |
| 45 | 9 |

TABLE 1-continued

| Zeta Potential (mV) | pH value |
|---|---|
| −9 | 11 |
| −11 | 12 |
| −15 | 13 |

The stability of the suspension was investigated with the aid of zeta potential measurements. Taking into consideration the results shown in FIG. 1 and the stability diagram of Barium Titanate, the inventors decide to work at pH values around 9.2. This allows work with high and positive zeta-potential while avoiding barium leaching.

Table 2 summarizes the working voltage, the green density of the deposited layer and the quality of the deposited layer as seen by SEM micrographs, according to an embodiment of the invention.

TABLE 2

| Voltage | Relative Green density (%) |
|---|---|
| 1 | 10 |
| 2 | 21 |
| 3 | 37 |
| 4 | 43 |
| 5 | 76 |
| 6 | 64 |

Table 2 illustrates relative densities of the Barium Titanate layer after a deposition process of 10 minutes when a distance of 8 cm was maintained between the cathode and the anode. For voltage potential below 1 V no deposition occurred on the nickel cathode. The highest green layer density was obtained for layers deposited at 5 V for 10 min.

In most cases of constant voltage mode the current decreases rapidly at the beginning of the deposition process and then (after a few seconds) remains constant or slowly decreases. The rapid decrement can result from an initial over-potential buildup. Low current densities were observed during deposition at low applied voltages, indicating there was a sufficient high resistance EPD cell.

When the thickness of the deposit is to be controlled, the rate at which the deposit forms during the EPD is very important. The thickness of the deposit films can be calculated using Equations 1 and 2, or observed by cross-section micrographs.

Figure 2:
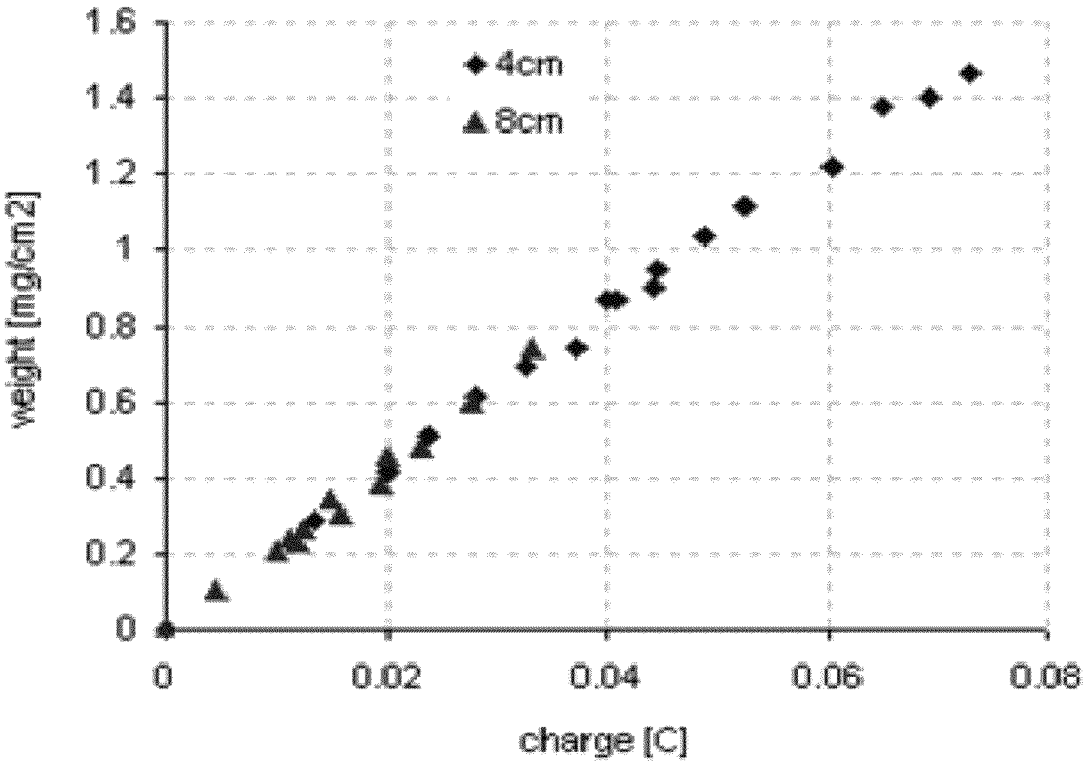
FIG. 2 illustrates the dependence between the deposited weight and electrical charge that was developed during the deposition process according to an embodiment of the invention.

FIG. 2 illustrates the dependence between the deposited weight and electrical charge that was developed during the deposition process according to an embodiment of the invention.

The charge equals an integral of current that passed through the cathode and anode during the deposition. When applying a constant current there is a linear relationship between the charge that the duration of the deposition. FIG. 2 illustrates the dependency between the deposited weight and electrical charge when the cathode and electrode were 4 cm from each other and when they were 8 cm from each other. FIG. 2 illustrates a deposited weight per charge ratio of about 20 Mg/($cm^2$*C.).

Figure 3:
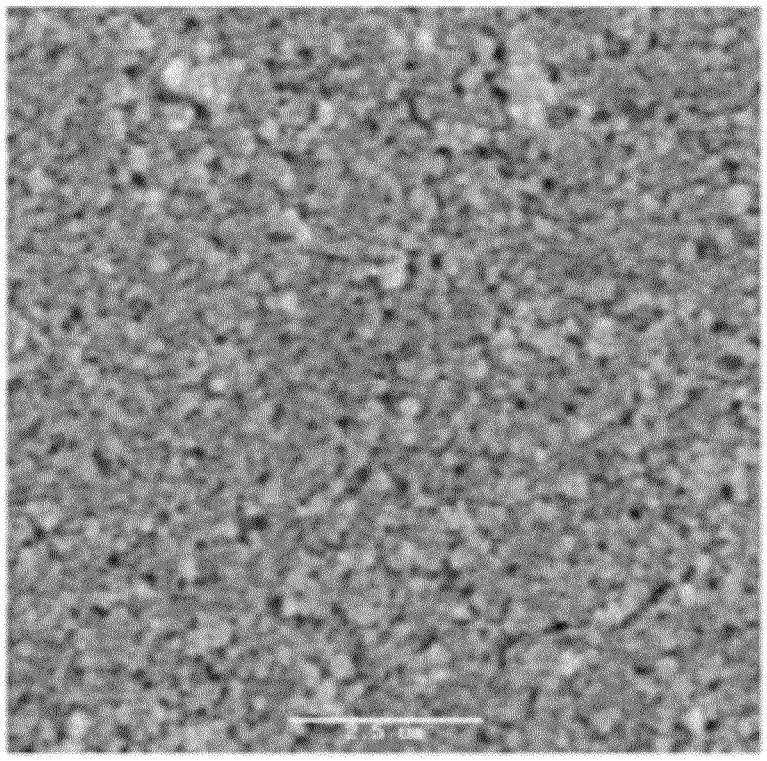
FIG. 3 shows an SEM micrograph of a deposited Barium Titanate layer according to an embodiment of the invention.

FIG. 3 is Scanning Electron Microscope image (SEM micrograph) of a deposited Barium Titanate layer according to an embodiment of the invention. The image illustrates a relatively uniform layer.

Figure 4:
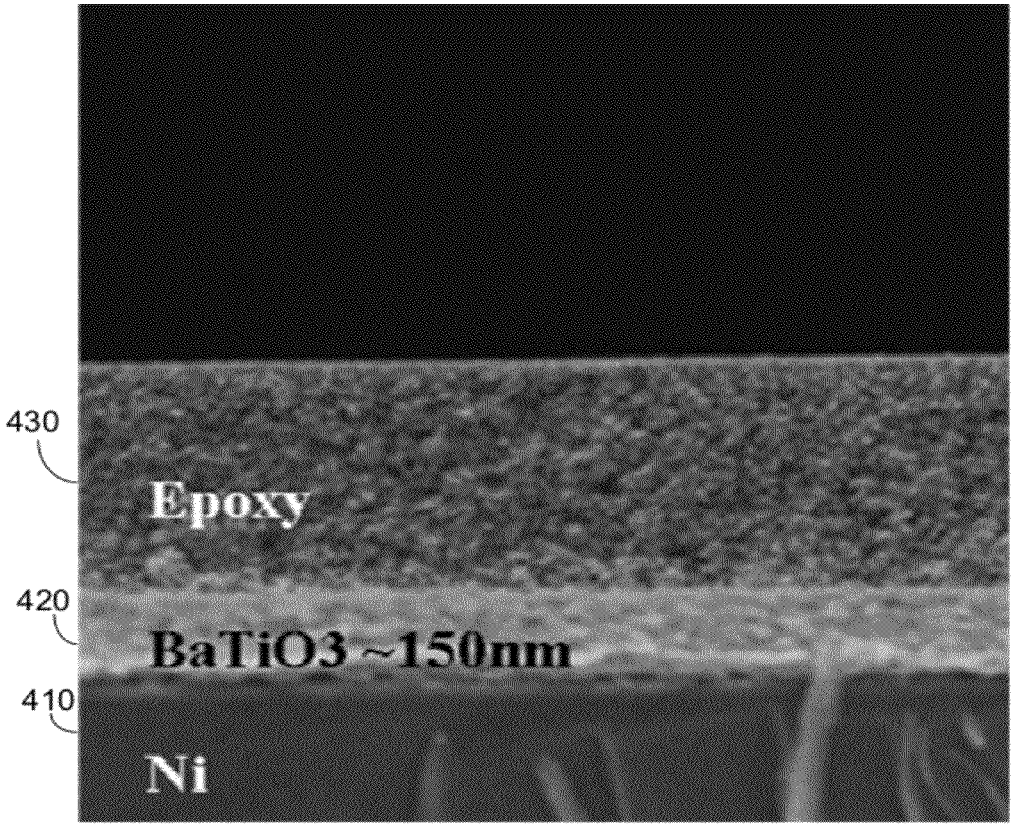
FIG. 4 shows a cross section of deposited Barium Titanate layer after sintering, according to an embodiment of the invention.

FIG. 4 shows a cross section of deposited Barium Titanate layer after sintering, according to an embodiment of the invention. The average thickness of the Barium Titanate layer 420 is 150 microns. Barium Titanate layer 420 is positioned between Epoxy layer 410 and Nickel layer 430.

Various modifications, variations, and alternatives of the mentioned above method and system are possible. The specifications and drawings are, accordingly, to be regarded in an illustrative rather than in a restrictive sense.

In the claims, the word 'comprising' does not exclude the presence of other elements or steps from those listed in a claim. It is understood that the terms so used are interchangeable under appropriate circumstances such that the embodiments of the invention described herein are, for example, capable of operation in other orientations than those illustrated or otherwise described herein.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

We claim:

1. A method for producing a Barium Titanate layer by cathodic electrophoretic deposition from an aqueous solution, the method comprises:

receiving or preparing an aqueous solution that comprises Barium Titanate and does not comprise organic materials; wherein the aqueous solution is characterized by a high positive zeta potential, low conductivity and a high pH value;

electrophoretically depositing Barium Titanate from the aqueous solution on a base metal cathode while substantially preventing oxidation of the base metal cathode;

drying the deposited Barium Titanate; and sintering the deposited Barium Titanate while substantially preventing the oxidation of the base metal cathode.

2. The method according to claim 1 wherein the depositing comprises maintaining a voltage potential between an anode and the base metal cathode that substantially prevents Oxidation of the base metal cathode.

3. The method according to claim 2 wherein the voltage potential ranges between 0.5 volts and 6 volts.

4. The method according to claim 2 wherein the voltage potential ranges between 3 and 4 volts.

5. The method according to claim 2 comprising maintaining a constant voltage potential between the anode and the base metal cathode during the electrophoretic deposit of the Barium Titanate.

6. The method according to claim 2 comprising maintaining a constant current between the anode and the base metal cathode during the electrophoretic deposit of the Barium Titanate.

7. The method according to claim 1 wherein the high pH value of the aqueous solution is selected to prevent Barium leaching.

8. The method according to claim 1 wherein the high pH value of the aqueous solution is about 9.2.

9. The method according to claim 1 wherein the high zeta potential is about 45 mili-Volts.

10. The method according to claim 1 comprises sonicating a mixture of a Barium Titanate powder and de-ionized water.

11. The method according to claim 10 comprising:

allowing the mixture to precipitate to provide a precipitate and supernatant water; and reducing the conductivity of the mixture.

12. The method according to claim 10 comprising adding oxalic acid and Polyethyleneimine to the mixture to provide the stability of the aqueous mixture.

13. The method according to claim 10, comprising mixing the de-ionized water with powders of $BaCl_2.2H_20$ and $TiCl_4$.

14. The method according to claim 1 comprising electrophoretically depositing the Barium Titanate on a base metal cathode that is made of Nickel.

15. The method according to claim 1 wherein the sintering comprises maintaining a low Oxygen partial pressure.

16. The method according to claim 1 wherein the sintering comprises maintaining an Oxygen partial pressure of about $10^{-10}$ Atmospheres.

17. The method according to claim 1 wherein the sintering comprises maintaining a low Oxygen partial pressure by directing a mixture of $H_2$ gas, dry $N_2$ and wet $N_2$ towards the base metal cathode.

* * * * *